US005732665A

United States Patent [19]

Morrison

[11] Patent Number: 5,732,665

[45] Date of Patent: Mar. 31, 1998

[54] HEAT EXCHANGER AND MARINE ENGINE COOLING APPARATUS

[76] Inventor: Douglas M. Morrison, Box 733-A, Hwy. 304, Thibodaux, La. 70301

[21] Appl. No.: 721,224

[22] Filed: Sep. 26, 1996

[51] Int. Cl.[6] ..... F01P 9/00

[52] U.S. Cl. ..... 123/41.01; 440/88; 165/44

[58] Field of Search ..... 123/41.01, 41.1; 165/41, 44, 51; 440/88

[56] References Cited

U.S. PATENT DOCUMENTS

| | | | |
|---|---|---|---|
| 3,561,524 | 2/1971 | Satterthwaite | 165/76 |
| 3,841,396 | 10/1974 | Knaebel et al. | 165/44 |
| 4,040,476 | 8/1977 | Telle et al. | 165/76 |
| 4,043,289 | 8/1977 | Walter | 115/75 |
| 4,360,350 | 11/1982 | Grover | 440/88 |
| 4,557,319 | 12/1985 | Arnold | 165/44 |
| 4,565,175 | 1/1986 | Kaye | 123/542 |
| 5,017,090 | 5/1991 | Morrison | 416/168 R |
| 5,102,301 | 4/1992 | Morrison | 416/163 |
| 5,104,291 | 4/1992 | Morrison | 416/168 R |

FOREIGN PATENT DOCUMENTS

| | | | |
|---|---|---|---|
| 2036952 | 8/1992 | Canada | 123/41.01 |

*Primary Examiner*—Noah P. Kamen

*Attorney, Agent, or Firm*—John F. Sieberth; R. Andrew Patty, II

[57] ABSTRACT

Novel apparatus and methods for cooling a watercraft internal combustion engine which supplies rotational force to a drive unit attached to the watercraft are described. The apparatus comprises a heat exchanger connected to or integral with the drive unit, the heat exchanger having therein a hollow loop connected to the engine cooling system for circulating a flow of fluid from the cooling system through the loop and thence back to the cooling system. The heat exchanger is adapted to be disposed in thermally-conductive heat exchange contact with water when the watercraft is being propelled by the drive unit. In a preferred embodiment, the heat exchanger extends from the watercraft in a substantially horizontal plane which is no lower than the bottom of the watercraft, is disposed above a propeller connected to the drive unit, and is sized and configured to deter cavitation around the propeller. The apparatus is uniquely adapted to provide an internal combustion engine cooling system for engines of watercraft propulsion systems operated in waters which are shallow and/or filled with vegetation or other floating debris.

21 Claims, 6 Drawing Sheets

HEAT EXCHANGER AND MARINE ENGINE COOLING APPARATUS

TECHNICAL FIELD

This invention relates to marine engine cooling apparatus and uses thereof.

BACKGROUND

Propulsion systems powered by internal combustion engines are commonly used on boats and other watercraft. As is well known, the internal combustion engine component of such systems generates significant heat during operation, and such heat in large part must be transferred away for the engine to perform properly. In marine applications, which for purposes of this disclosure includes both fresh, salt and brackish water conditions, such engines commonly are engineered to include a cooling system which circulates water from outside the watercraft into the engine block and back out of the engine block to transfer heat away from the engine. Such cooling systems are often referred to as open cooling systems, since these systems permit the inflow of a heat-conductive fluid from an external source (i.e., the surrounding body of water), and the outflow of the heated fluid from the system without recirculation. This is contrasted with closed cooling systems which recirculate a heat-conductive fluid through the engine into an accompanying radiator or other apparatus which transfers heat from the fluid to the surrounding air, and which do not permit constant introduction or expulsion of the fluid. Open cooling systems heretofore have been preferred in many marine applications because of limitations posed by closed cooling systems that require significant influx of air to properly function. However, marine applications are known which utilize a closed system using a hollow keel within which a heat exchanger is disposed.

A major disadvantage of known cooling systems in internal combustion engines for marine applications is highlighted when the water being traversed is shallow and/or filled with vegetation or other floating debris. Under such circumstances, the inflow of fresh water to an open cooling system or the outflow of heated water can be significantly impaired when mud, silt, sand, or other debris clogs the system's water inflow path. Engine overheating is often the result because the cooling system becomes inoperative as the flow of fresh water through the system ceases. Likewise, closed cooling systems which require components to be attached to or integral with the bottom or keel portion of the hull of a boat are vulnerable to puncture or other damage in shallow waters, calling into question the integrity of these cooling systems under such conditions. They also require an additional point of connection to the boat hull which can cause leaks or other structural problems. Thus, a need exists for an internal combustion engine cooling system which enjoys the advantages of open cooling systems in internal combustion engines for marine applications, while avoiding the disadvantages of such systems when applied in waters which are shallow and/or filled with vegetation or other floating debris.

SUMMARY OF THE INVENTION

The present invention is deemed to fulfill this need by providing apparatus for cooling an internal combustion engine which supplies rotational force to a drive unit attached to a watercraft, such engine having a cooling system through which a heat-conductive fluid flows. The apparatus comprises a heat exchanger connected to or integral with the drive unit and having therein a hollow loop connected to the cooling system for circulating a flow of the fluid from the cooling system through the loop and thence back to the cooling system. The heat exchanger is adapted to be disposed in thermally-conductive heat exchange contact with water when the watercraft is being propelled by the drive unit.

In a preferred embodiment of this invention, the cooling system comprises a labyrinth of hollow pathways within the engine for circulating the fluid through the engine during operation, the engine provides an inlet and an outlet for the labyrinth to permit the fluid to enter and exit the engine during operation, and the heat-exchanger is external to the engine and is directly or indirectly connected to the inlet and to the outlet.

Also in preferred embodiments, during normal operation the watercraft is submerged in the water up to a water line which surrounds the watercraft, the heat-exchanger extends from the watercraft in a substantially horizontal plane which is no lower than the bottom of the watercraft, and the heat exchanger is disposed within a plane which is at or below the water line. In another preferred embodiment, the heat exchanger is disposed above a propeller connected to the drive unit and is sized and configured to deter cavitation around the propeller.

This invention also provides a method of cooling an internal combustion engine which supplies rotational force to a drive unit attached to a watercraft, such engine having a cooling system through which a heat-conductive fluid flows. This method comprises (i) attaching to the drive unit a heat exchanger having therein a hollow loop for circulating a flow of the fluid from the cooling system through the loop and thence back to the cooling system, the heat exchanger being adapted to be disposed in thermally-conductive heat exchange contact with the water when the watercraft is being propelled by the engine, (ii) connecting said heat exchanger to said cooling system, and (iii) placing all or substantially all of the heat exchanger in thermally-conductive heat exchange contact with the water.

In yet another embodiment, this invention provides a method of deterring cavitation around a propeller of a drive unit attached to a watercraft, while concurrently cooling an internal combustion engine which supplies rotational force to the drive unit, the engine having a cooling system through which a heat-conductive fluid flows. This method comprising (i) attaching to the drive unit a heat exchanger in the form of a plate within a plane above the propeller, the heat exchanger having therein a hollow loop for circulating a flow of the fluid from the cooling system through the loop and thence back to the cooling system, the heat exchanger being sized and configured to deter cavitation around the propeller and being adapted to be disposed in thermally-conductive heat exchange contact with the water when the watercraft is being propelled by the drive unit, (ii) connecting the heat exchanger to the cooling system, and (iii) placing all or substantially all of the heat exchanger in thermally-conductive heat exchange contact with the water.

These and other embodiments and features of the invention will become still further apparent from the ensuing description, accompanying drawings and appended claims.

BRIEF DESCRIPTION OF THE DRAWINGS

In the Figures, like numerals and/or letters represent like parts among the different Figures.

FURTHER DETAILED DESCRIPTION

As described above, the apparatus of this invention provides a system by which the internal combustion engine of a watercraft may be cooled utilizing a heat exchanger which is substantially or completely submerged in the surrounding water in such a way so as to permit operation of the engine in shallow waters or in waters filled with vegetation and/or other floating debris.

Figure 1:
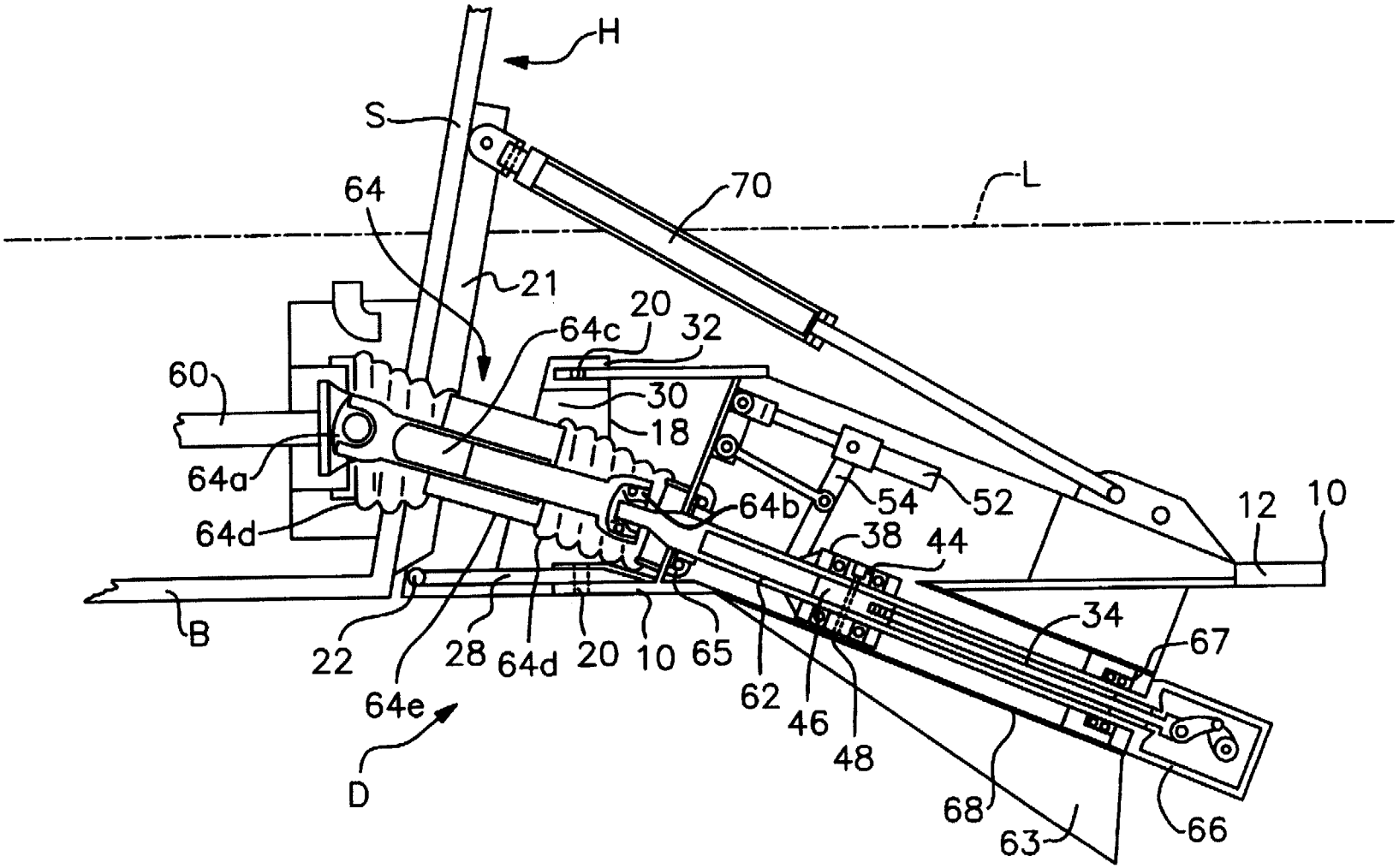
FIG. 1 is a cross-sectional view of a preferred embodiment of this invention partially broken away.
Figure 4:
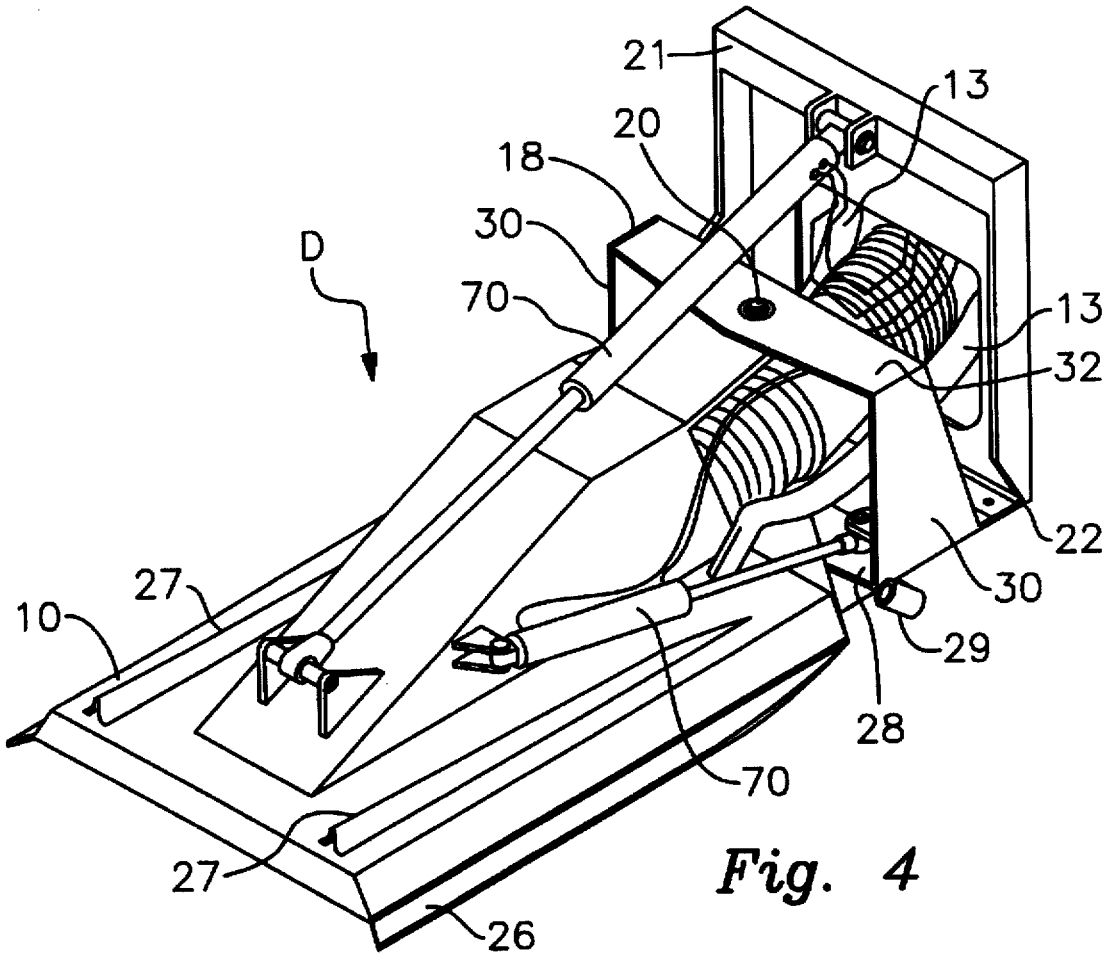
FIG. 4 is a view in perspective of the device of FIG. 1.

Referring now to the drawings, FIGS. 1 through 4 depict a preferred embodiment of this invention. While this particular embodiment is preferred, it will be appreciated by those skilled in the art that the particular cooling apparatus depicted may be employed in a wide variety of watercraft propulsion systems which include an internal combustion engine. As seen in FIG. 1, this invention provides apparatus for cooling an internal combustion engine (not shown) which supplies rotational force to a drive unit attached to a watercraft, the engine having a cooling system through which a heat-conductive fluid flows. The watercraft has a hull H which, in turn, has a bottom portion B, and a stern portion S. Drive unit D is attached to stern portion S. The apparatus of this invention comprises a heat exchanger 10 attached to drive unit D and having therein a hollow loop 12 connected to the inlet and outlet of the cooling system by a pair of hoses or other hollow tubing 13 (FIG. 4 only) extending through hull H and connected, in turn, to an inlet nipple 14 and an outlet nipple 16 (seen on FIGS. 2 and 3) for circulating a flow of heat-conductive fluid from the cooling system through loop 12 and thence back to the cooling system. Heat exchanger 10 is pivotally attached to a dual pivot. coupling 18 via pivot pins 20. Dual pivot coupling 18, in turn, is pivotally attached to a transom plate 21 at a point proximate to the juncture of stern portion S and bottom portion B via a hinge 22 (FIGS. 1 and 4 only). Transom plate 21, in turn, is fixedly yet detachably attached to stern portion S. Alternative configurations for attaching drive unit D (and therefore heat exchanger 10) to stern portion S are described in my copending patent application U.S. Ser. No. 721,354, filed on Sep. 26, 1996. It may be seen from FIG. 1 that, during normal operation, hull H is submerged in water up to a water line L which surrounds hull H, and heat exchanger may extend from stern portion S in a substantially horizontal plane which is typically no higher than water line L, and is no lower than bottom portion B. Of course, the actual depth of hull submersion can vary depending upon watercraft design and/or speed.

In the preferred embodiment depicted, the watercraft's propulsion system also is adapted to permit use of the watercraft in shallow waters or in waters filled with vegetation and/or other floating debris. The preferred apparatus for so adapting the propulsion system of a watercraft is further described in the copending patent application mentioned above and having U.S. Ser. No. 721,354, filed on Sep. 26, 1996. The engine has a drive shaft 60 which is connected to, and in rotational relationship with, a hollow rotary shaft 62 by joint boot assembly 64. Boot assembly 64 further comprises a universal joint spline **64*a* connected to shaft 60, a constant velocity joint 64*b* which cooperates with rotary shaft 62, an intermediate rotary shaft 64*c* between spline 64*a* and joint 64*b*, two sealing boots 64*d*, and a hollow protective casing 64*e*. Rotary shaft 62, in turn, is connected to, and in rotational relationship with, a reversible pitch propeller 66 (propeller blades not depicted). Thrust bearings 65 and 67 are also provided for transferring propeller thrust to portions of the apparatus surrounding rotary shaft 62. A fin 63 extends downwardly from the underside of the apparatus and in front of propeller 66. Fin 63 shields propeller 66 from large stationary objects encountered in shallow waters by forcing the apparatus, and therefore propeller 66**, upward upon contact with such objects.

To make the pitch of propeller 66 reversive, a pitch adjusting shaft 34, a solid cylindrical slide 46, a rotary collar-type bearing housing 38, an arm 54, and a hydraulic ram 52 are provided. An interior rotary portion 44 of housing 38 rotates with rotary shaft 62 and includes a pin 48 which extends through rotary shaft 62 and slide 46. Slide 46 is connected to shaft 34 so that, when ram 52 is hydraulically activated to move housing 38 along the rotational axis of shaft 62, ram 52 also moves slide 46 and shaft 34 along the along the same axis. These pitch adjusting means are further described in the copending patent application mentioned above and having U.S. Ser. No. 721,354, filed on Sep. 26, 1996. Reversible pitch propeller 66 is described in greater detail in Applicant's U.S. Pat. Nos. 5,017,090, 5,102,301, and 5,104,291. Rotary shaft 62 is also disposed within a sleeve 68 which is connected to heat exchanger 10. In this way, heat exchanger 10 effectively surrounds rotary shaft 62. By locating heat exchanger 10 at the stern of the watercraft as a component to the propulsion system separate from the hull of the watercraft, the propulsion system is uniquely capable of cooling its own internal combustion engine without requiring hull design modification to integrate the heat exchanger with the hull, and without creating significant watercraft drag.

Figure 2:
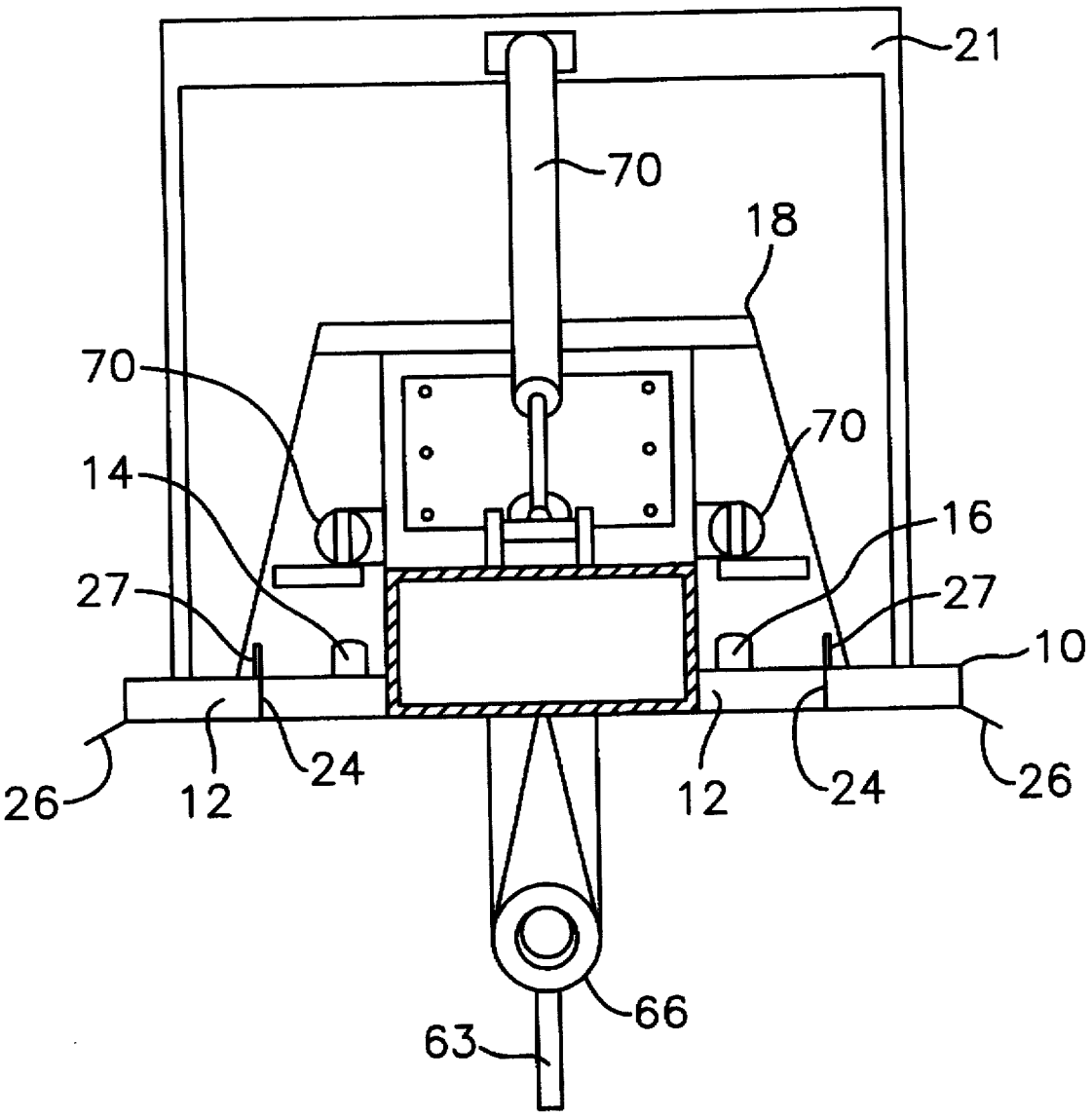
FIG. 2 is a cross-sectional view of the device of FIG. 1 perpendicular to the view illustrated in FIG. 1.
Figure 3:
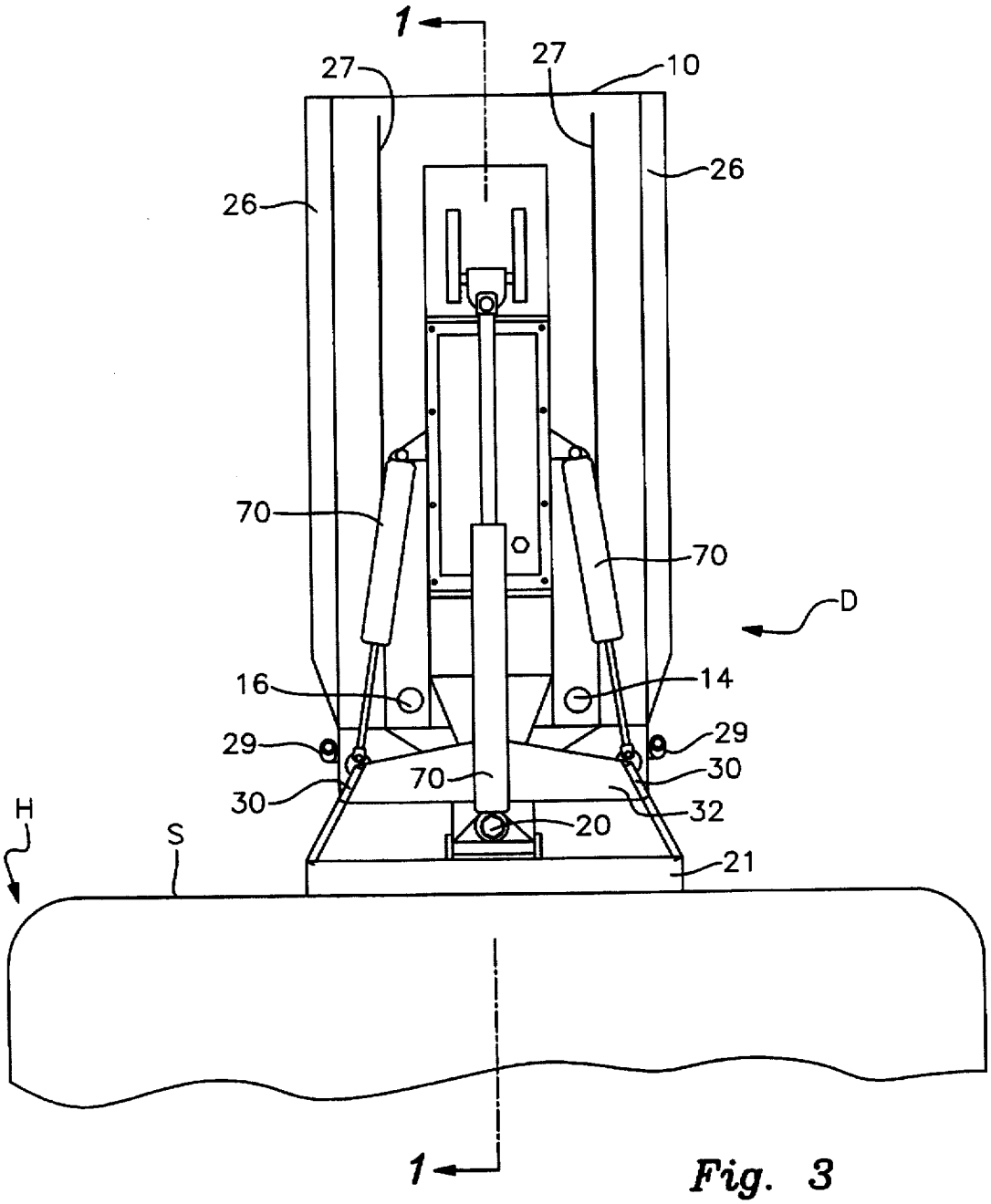
FIG. 3 is a top plan view of the device of FIG. 1 partially broken away.
Figure 5:
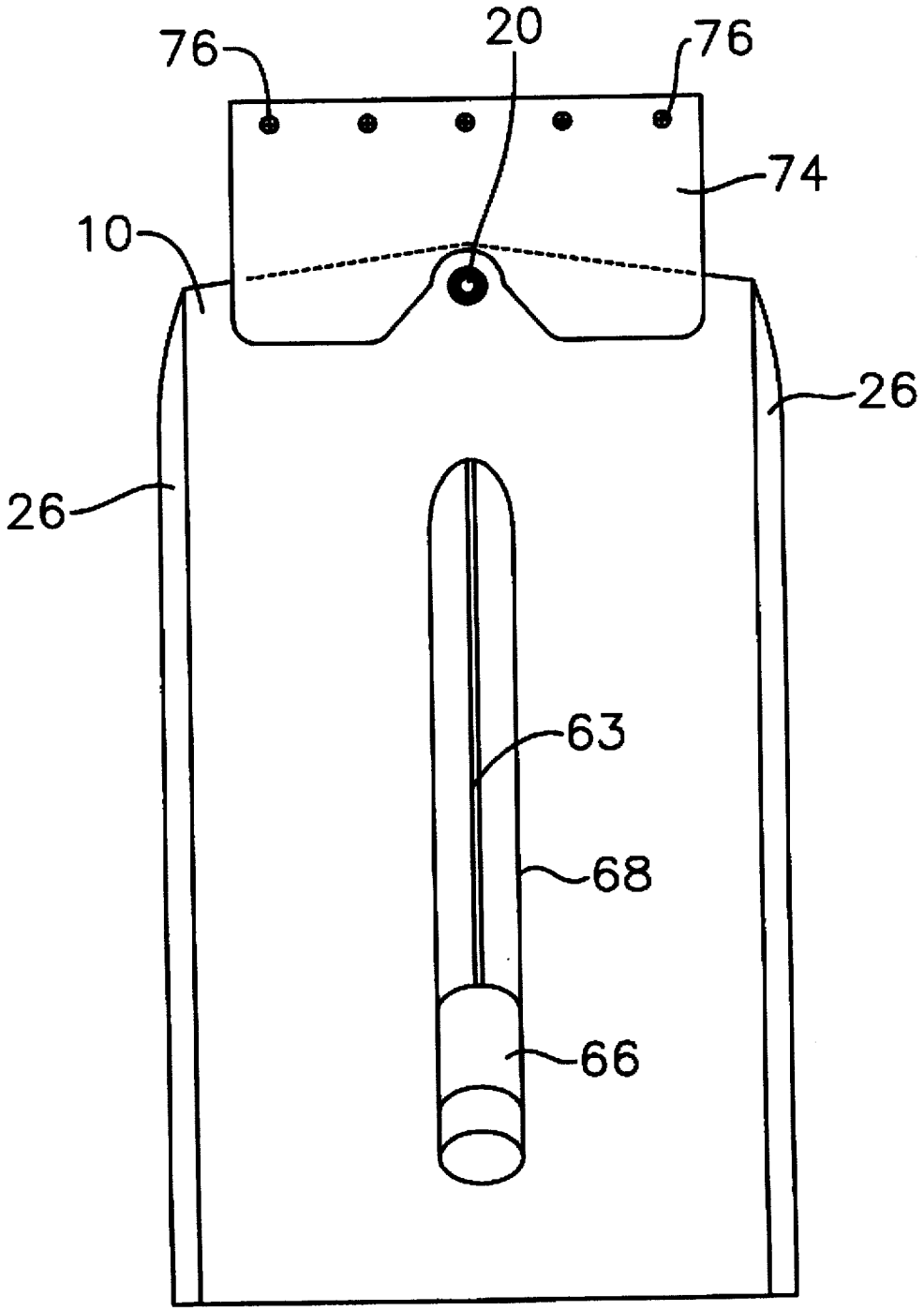
FIG. 5 is a plan view of the underside of the device of FIG. 1.

As illustrated in FIG. 2, loop 12 includes a plurality of channels formed by walls 24 which extend through lateral portions of heat exchanger 10, thereby facilitating heat exchange between heat-conductive fluid flowing through heat exchanger 10 and the surrounding water. In the preferred embodiment of FIG. 2, heat exchanger 10 includes two downwardly disposed ridges 26 extending from the lateral sides of heat exchanger 10. These flanges extend from the lateral sides at an angle below horizontal, preferably an angle which is between about 30 and 60 degrees. With regard to the distance between the lateral sides of heat exchanger 10, it is preferred that the ratio of propeller diameter (i.e., the diameter of the circle formed by the most radial propeller blade edges during normal propeller rotation) to cavitation plate width (i.e., the distance from the most lateral edge of one flange 26 to the most lateral edge of the other flange 26) is no greater than about 0.75. Flanges 26, in combination with heat exchanger 10, act to direct water toward propeller 66 during operation of the propulsion system and aid in preventing cavitation within the water flow about the propeller blades. In essence, the heat exchanger acts as a cavitation plate. In this way, heat exchanger 10 serves the dual purposes of propulsion augmentation through prevention of cavitation, and simultaneous engine coolant heat exchange through contact with the surrounding water. In yet another preferred embodiment illustrated particularly on FIG. 5, the cavitation plate is actually composed of two planar members, heat exchanger 10 serving as the primary planar member, and a supplemental plate 74 serving as a secondary planar member. FIG. 5 shows the planar members in a bottom view of an apparatus of this invention. Plate 74 in this embodiment is a solid plate attached to the bottom of transom plate 21 by a plurality of screws 76, and may be flat or undulating to accommodate different types of coupling between the apparatus and the stern. In the embodiment illustrated, plate 74 is separate from coupling 18 and heat exchanger 10 and is attached to transom plate 21 to prevent forced water from flowing therebetween when the propulsion system is in a forward or reverse thrust setting. An additional feature when using forward thrust is provided by plate 74 in that watercraft planing occurs more quickly. In alternative embodiments, plate 74 is separate from coupling 18, but is undulated to maintain a close fit between these components even during coupling movement. In this way, heat exchanger 10 and plate 74 form a substantially contiguous, horizontal undersurface extending from the stern of the watercraft to a point aft of the propeller. Thus, in addition to its other functions, heat exchanger 10 as applied here permits efficient application of significant forward or reverse propeller thrust without the traditional problems of water flow over the stern and into the watercraft; and all of this even at different levels of vertical trim.

As noted earlier, pivot pins 20 serve to pivotally attach heat exchanger 10 to dual pivot coupling 18, while coupling 18 is pivotally attached to transom plate 21 by hinge 22. Heat exchanger 10 pivots relative to coupling 18 along a substantially vertical axis, so as to permit lateral movement of heat exchanger 10 relative to hull H. In addition, coupling 18 pivots relative to hull H and transom plate 21 along a substantially horizontal axis, so as to permit vertical movement of heat exchanger 10, rotary shaft 62, and propeller 66. As seen on FIG. 3, these vertical and lateral movements are controlled by a plurality of hydraulic rams 70. Coupling 18 in the particular embodiment illustrated is formed by a substantially horizontal base plate 28, two upstanding flanges 30,30 and a bridge member 32 connecting the top portion of flanges 30. FIG. 4 presents a view in perspective of the above-described embodiment of this invention.

To increase the cooling capacity of heat exchanger 10, as for example when larger engines are used in conjunction with the apparatus, it is preferred that heat exchanger 10 include one or more cooling fins 27 extending upwardly from the top of heat exchanger 10. To even further improve the cooling capacity of heat exchanger 10, the apparatus preferably includes a water deflector 29 attached, for example, to flange 30 for deflecting at least a spray of water onto the top surface of heat exchanger 10, thereby further increasing the effectiveness of heat exchanger 10. Of course, deflector 29 may be attached to a variety of different components of the apparatus, so long as the end result is deflection of water onto the top of heat exchanger 10. Thus, as may be seen from FIG. 4, as the apparatus propels the, watercraft through water at high speeds, a spray of water is deflected by deflector 29 onto the top of exchanger 10 and the cooling fins 27. These preferred embodiments are particularly effective when the apparatus of this invention is used in conjunction with diesel marine engines and/or engines having about 100 horse power or greater.

Figure 6:
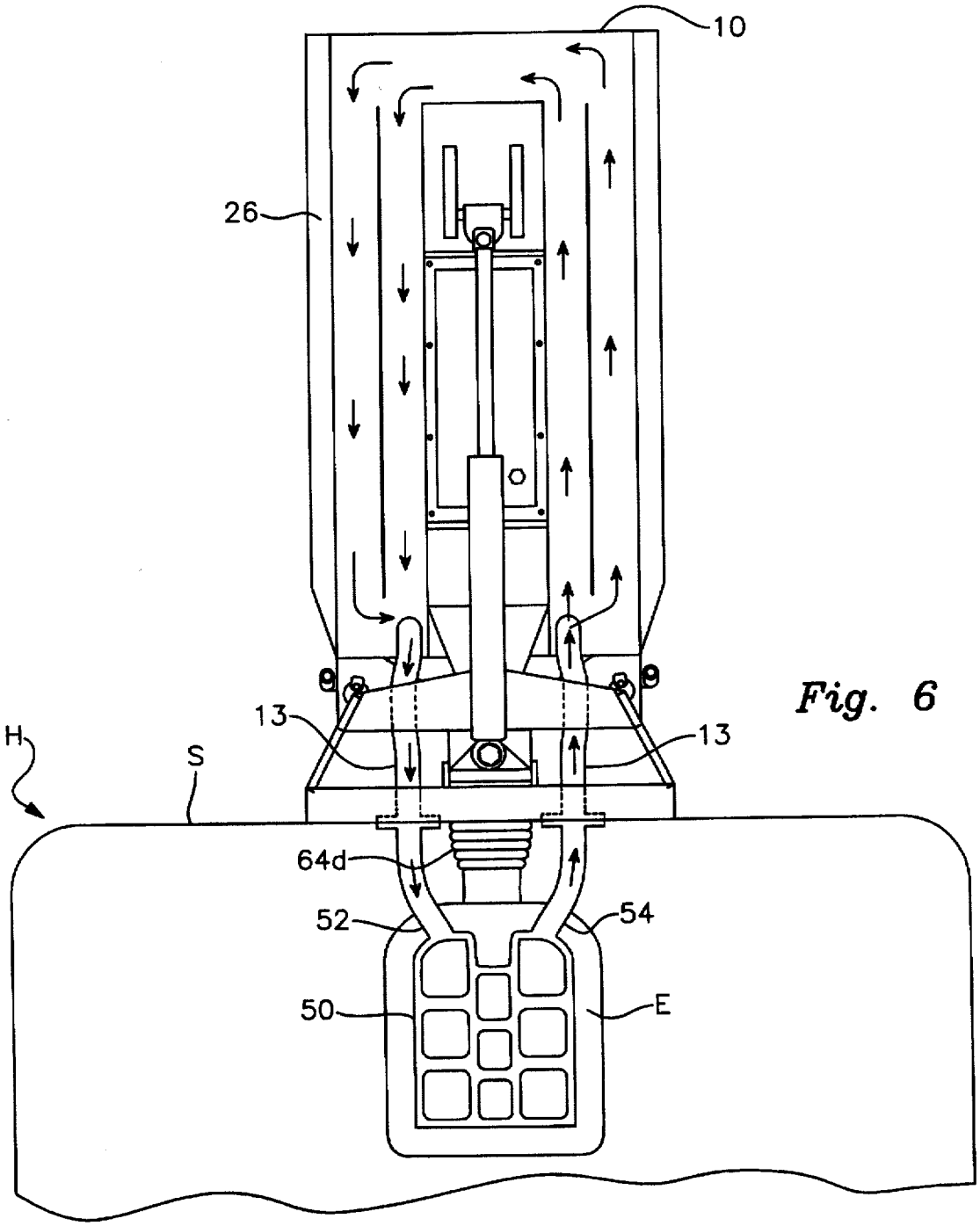
FIG. 6 is a top plan view of the device of FIG. 1 partially disassembled and illustrating the flow of coolant fluid within the device of FIG. 1.

As may be seen from FIG. 6, the cooling system of a preferred embodiment of this invention comprises a labyrinth of hollow pathways 50 within an engine E for circulating the heat-conductive fluid through engine E during operation. Engine E provides an inlet 52 and an outlet 54 for labyrinth 50 to permit the fluid to enter and exit engine E during operation, and heat-exchanger 10 is external to engine E and may be connected directly or, as illustrated, indirectly to inlet 52 and to outlet 54 by an intermediate member in the form of tubing 13,13. It will be noted that, for the sake of simplifying the illustration, two of the hydraulic rams 70 are not illustrated in FIG. 6. The lines with arrows indicated on FIG. 6 illustrate the flow of fluid through the engine and the heat exchanger during operation of this preferred device.

A variety of fluids may serve as the heat-conductive fluid utilized in this invention, ranging in type from fresh water to conventional commercially available synthetic compositions and engine coolants, including mixtures thereof. The heat exchanger of this invention may be fabricated from a variety of heat-conductive materials, but is preferably fabricated from a heat-conductive metal. Suitable heat-conductive metals include, for example, stainless steel, aluminum, aluminum alloys, or the like. Most preferably, the heat conductive metal used is an aluminum alloy. Additionally, it should be understood that the loop which extends through the heat exchanger of this invention may include one or more channels or pathways through which heat-conductive fluid may flow. The particular configuration of the loop is not a limitation of this invention, provided that the heat-conductive function of the heat exchanger is not impaired thereby.

The entire disclosure of each and every U.S. patent or patent application, and of each other publication of any kind, referred to in any portion of this specification is incorporated herein by reference.

This invention is susceptible to considerable variation in its practice. Therefore the foregoing description is not intended to limit, and should not be construed as limiting, the invention to the particular forms of the invention described with reference to the drawings. Rather, what is intended to be covered is as set forth in the ensuing claims and the equivalents thereof permitted as a matter of law.

What is claimed is:

1. Apparatus for cooling an internal combustion engine which supplies rotational force to a drive unit attached to a watercraft, said drive unit comprising a rotary shaft for rotating a propeller, and a housing encasing said rotary shaft, said engine having a cooling system through which a heat-conductive fluid flows, said apparatus comprising a heat exchanger connected to or integral with said drive unit and having therein a hollow loop connected to said cooling system for circulating a flow of said fluid from said cooling system through said loop and thence back to said cooling system, said heat exchanger being (i) adapted to be disposed above said propeller and in thermally-conductive heat exchange contact with water when said watercraft is being propelled by said drive unit, and (ii) sized and Configured to deter cavitation around said propeller.

2. Apparatus in accordance with claim 1 wherein, during normal operation, said watercraft is submerged in said water up to a water line which surrounds said watercraft, said heat exchanger extends from said watercraft in a substantially horizontal plane which is no lower than the bottom of said watercraft, and said heat exchanger is disposed within a plane which is at or below said water line.

3. Apparatus in accordance with claim 1 wherein said heat exchanger is fabricated from a heat-conductive metal.

4. Apparatus in accordance with claim 3 wherein said heat exchanger is fabricated from an aluminum alloy.

5. Apparatus in accordance with claim 1 wherein said cooling system comprises a labyrinth of hollow pathways within said engine for circulating said fluid through said engine during operation, said engine provides an inlet and an outlet for said labyrinth to permit said. fluid to enter and exit said engine during operation, and said heat-exchanger is external to said engine and is connected to said inlet and to said outlet.

6. Apparatus in accordance with claim 5 wherein said heat exchanger is fabricated from a heat-conductive metal.

7. Apparatus in accordance with claim 6 wherein said heat-conductive metal is an aluminum alloy.

8. Apparatus in accordance with claim 5 wherein, during normal operation, said watercraft is submerged in said water up to a water line which surrounds said watercraft, said heat exchanger extends from said watercraft in a substantially horizontal plane which is no lower than the bottom of said watercraft, and said heat exchanger is disposed in a plane which is at or below said water line.

9. Apparatus in accordance with claim 8 wherein said heat exchanger is fabricated from a heat-conductive metal.

10. Apparatus in accordance with claim 9 wherein said heat-conductive metal is art aluminum alloy.

11. A method of cooling an internal combustion engine which supplies rotational force to a drive unit attached to a watercraft, said drive unit comprising a rotary shaft for rotating a propeller, and a housing encasing said rotary shaft, said engine having a cooling system through which a heat-conductive fluid flows, said method comprising (i) attaching to said drive unit a heat exchanger having therein a hollow loop for circulating a flow of said fluid from said cooling system through said loop and thence back to said cooling system, said heat exchanger being adapted to be disposed above said propeller and in thermally-conductive heat exchange contact with said water when said watercraft is being propelled by said drive unit and said heat exchanger being sized and configured to deter cavitation around said propeller, (ii) connecting said heat exchanger to said cooling system, and (iii) placing all or substantially all of said heat exchanger in thermally conductive heat exchange contact with said water.

12. A method in accordance with claim 11 wherein, during normal operation, said watercraft is submerged in said water up to a water line which surrounds said watercraft, said heat exchanger extends from said watercraft in a substantially horizontal plane which is no lower than the bottom of said watercraft, said heat exchanger is disposed within a plane which is at or below said water line.

13. A method in accordance with claim 11 wherein said heat exchanger is fabricated from a heat-conductive metal.

14. A method in accordance with claim 13 wherein said heat-conductive metal is aluminum alloy.

15. A method in accordance with claim 11 wherein said cooling system comprises a labyrinth of hollow pathways within said engine for circulating said fluid through said engine during operation, said engine provides an inlet and an outlet for said labyrinth to permit said fluid to enter and exit said engine during operation, and said heat exchanger is external to said engine and is connected to said inlet and to said outlet.

16. A method in accordance with claim 15, during normal operation, said watercraft is submerged in said water up to a water line which surrounds said watercraft, said heat exchanger extends from said watercraft in a substantially horizontal plane which is no lower than the bottom of said watercraft, and said heat exchanger is disposed in a plane which is at or below said water line.

17. A method in accordance with claim 16 wherein said heat exchanger is fabricated from a heat-conductive metal.

18. A method in accordance with claim 17 wherein said heat-conductive metal is an aluminum alloy.

19. A method in accordance with claim 15 wherein said heat exchanger is fabricated from a heat-conductive metal.

20. A method in accordance with claim 19 wherein said heat-conductive metal is an aluminum alloy.

21. A method of deterring cavitation around a propeller when rotated by a drive unit attached to a watercraft, while concurrently cooling an internal combustion engine which supplies rotational force to said drive unit, said drive unit comprising a rotary_ shaft for rotating said propeller, and a housing encasing said rotary_ shaft, said engine having a cooling system through which a heat-conductive fluid flows, said method comprising (i) attaching to said drive unit a heat exchanger in the form of a plate within a plane above said propeller, said heat exchanger having therein a hollow loop for circulating a flow of said fluid from said cooling system through said loop and thence back to said cooling system, said heat exchanger being sized and configured to deter cavitation around said propeller and being adapted to be disposed in thermally-conductive heat exchange contact with said water when said watercraft is being propelled by said drive unit, (ii) connecting said heat exchanger to said cooling system, and (iii) placing all or substantially all of said heat exchanger in thermally-conductive heat exchange contact with said water.

* * * * *

UNITED STATES PATENT AND TRADEMARK OFFICE

CERTIFICATE OF CORRECTION

PATENT NO. : 5,732,665

DATED : March 31, 1998

INVENTOR(S) : Douglas M. Morrison

It is certified that error appears in the above-identified patent and that said Letters Patent is hereby corrected as shown below:

Claim 1, Column 6, line 52 reads "Configured" and should read --configured--.

Claim 5, Column 7, line 2, reads "said." and should read --said--.

Claim 10, Column 7, line 20, reads "art" and should read --an--.

Claim 11, Column 7, line 37, reads "thermally conductive" and should read --thermally-conductive--.

Claim 14, Column 8, line 2, reads "is aluminum" and should read --is an aluminum--.

Claim 21, Column 8, line 30, reads "rotary_shaft" and should read --rotary shaft--.

Claim 21, Column 8, line 31, reads "rotary_shaft and should read --rotary shaft--.

Signed and Sealed this

Sixteenth Day of June, 1998

*Attest:*

Bruce Lehman

BRUCE LEHMAN

*Attesting Officer*

*Commissioner of Patents and Trademarks*